US011751735B2

(12) United States Patent
Olewiler

(10) Patent No.: US 11,751,735 B2
(45) Date of Patent: Sep. 12, 2023

(54) VACUUM AND HOSE RETRACTION SYSTEM

(71) Applicant: M.D. Manufacturing, Inc., Bakersfield, CA (US)

(72) Inventor: Grant Olewiler, Bakersfield, CA (US)

(73) Assignee: M.D. Manufacturing, Inc., Bakersfield, CA (US)

( * ) Notice: Subject to any disclaimer, the term of this patent is extended or adjusted under 35 U.S.C. 154(b) by 345 days.

(21) Appl. No.: 16/889,598

(22) Filed: Jun. 1, 2020

(65) Prior Publication Data

US 2021/0369066 A1 Dec. 2, 2021

(51) Int. Cl.
*A47L 5/30* (2006.01)
*A47L 9/24* (2006.01)
(Continued)

(52) U.S. Cl.
CPC ..... *A47L 5/30* (2013.01); *A47L 9/009* (2013.01); *A47L 9/0411* (2013.01);
(Continued)

(58) Field of Classification Search
CPC ..... A47L 5/30; A47L 5/36; A47L 5/38; A47L 9/009; A47L 9/0411; A47L 9/0466;
(Continued)

(56) References Cited

U.S. PATENT DOCUMENTS 2,051,728 A * 8/1936 Manning ..... A47L 5/365 15/327.2
2,953,806 A 9/1960 Walker
(Continued)

FOREIGN PATENT DOCUMENTS

CA 880976 A 9/1917
CA 881627 A 9/1971
(Continued)

OTHER PUBLICATIONS

117507 Lamb Vacuum Motor, Amazon, available Jun. 29, 2006, https://www.amazon.com/Ametek-117507-Lamb-Vacuum-Motor/dp/B000GJEQWI/ref=sr_1_2?crid=2YJ03WH5SK4MZ&keywords=117507+lamb+vacuum+motor&qid=1660166917&sprefix=117507+lamb+vaccuum+motor%2Caps%2C81&sr=8-2 (Year: 2006).*
(Continued)

*Primary Examiner* — David Redding
*Assistant Examiner* — Michael A Gump
(74) *Attorney, Agent, or Firm* — Sierra IP Law, PC; Mark D. Miller

(57) ABSTRACT

The present invention provides unique portable or stationary hose retraction systems in a single compact unit having an elongated hose, a chamber or plenum for storing the hose, a primary vacuum source for creating suction in the hose, and a secondary vacuum source for retracting the hose into the chamber. Embodiments may include one or more switches located at a distal end of the hose for controlling the primary and secondary vacuum sources. Other embodiments include a movable robotic unit with a proximity generating signal at the distal end of the hose, whereby the robotic unit may withdraw the hose as needed during use, and the secondary vacuum source may retract slack in the hose during use, or may retract the entire hose and the robotic unit after use.

12 Claims, 12 Drawing Sheets

(51) Int. Cl.

| | |
|---|---|
| ***A47L 9/26*** | (2006.01) |
| ***A47L 9/28*** | (2006.01) |
| ***A47L 9/00*** | (2006.01) |
| ***A47L 9/30*** | (2006.01) |
| ***A47L 9/04*** | (2006.01) |
| *A47L 9/32* | (2006.01) |

(52) U.S. Cl.

CPC ..... *A47L 9/0466* (2013.01); *A47L 9/242* (2013.01); *A47L 9/248* (2013.01); *A47L 9/26* (2013.01); *A47L 9/2857* (2013.01); *A47L 9/2868* (2013.01); *A47L 9/30* (2013.01); *A47L 9/325* (2013.01); *A47L 2201/04* (2013.01)

(58) Field of Classification Search

CPC . A47L 9/242; A47L 9/248; A47L 9/26; A47L 9/2857; A47L 9/2868; A47L 9/30; A47L 9/325; A47L 9/0036; A47L 9/246; A47L 9/2842; A47L 9/0063; A47L 9/0009; A47L 9/24; A47L 9/244; A47L 2201/04; A47L 2201/02

USPC ..... 15/301, 314, 315

See application file for complete search history.

(56) References Cited

U.S. PATENT DOCUMENTS

| | | | | |
|---|---|---|---|---|
| 3,023,447 | A | 3/1962 | Senne | |
| 3,213,480 | A | 10/1965 | Miller | |
| 3,353,996 | A | 11/1967 | Hamrick | |
| 3,464,859 | A | 9/1969 | Hamrick | |
| 3,520,725 | A | 7/1970 | Hamrick | |
| 3,568,240 | A | 3/1971 | Hamrick | |
| 3,593,363 | A | 7/1971 | Hamrick | |
| 3,651,536 | A | 3/1972 | Bolzan et al. | |
| 3,682,500 | A | 8/1972 | Hamrick | |
| 3,911,944 | A | 10/1975 | Hukuba et al. | |
| 3,942,963 | A | 3/1976 | Tevis | |
| 3,958,297 | A | 5/1976 | Hukuba et al. | |
| 3,977,037 | A | 8/1976 | Miyake et al. | |
| 3,977,038 | A | 8/1976 | Hukuba et al. | |
| 4,050,113 | A | 9/1977 | Wright et al. | |
| 4,211,457 | A | 7/1980 | Meadows | |
| 4,246,675 | A | 1/1981 | Costanzo | |
| 4,259,066 | A | 3/1981 | Pietschmann | |
| 4,316,304 | A | 2/1982 | Parise et al. | |
| 4,336,427 | A | 6/1982 | Lindsay | |
| 4,462,649 | A | 7/1984 | Medford et al. | |
| 4,564,457 | A | 1/1986 | Cairo et al. | |
| 4,634,197 | A | 1/1987 | Horlacher | |
| 4,688,292 | A * | 8/1987 | Schmiegel | A47L 5/38 15/422.2 |
| 4,688,596 | A | 8/1987 | Liebmann et al. | |
| 4,846,712 | A | 7/1989 | Holden et al. | |
| 4,894,020 | A | 1/1990 | Holden et al. | |
| 4,895,528 | A | 1/1990 | Choiniere et al. | |
| 5,069,635 | A | 12/1991 | Holden et al. | |
| 5,119,843 | A | 6/1992 | Keenan | |
| 5,402,551 | A | 4/1995 | Workhoven et al. | |
| 5,430,978 | A | 7/1995 | Kohler | |
| 5,526,842 | A | 6/1996 | Christensen | |
| 5,578,795 | A | 11/1996 | Ward | |
| 5,740,581 | A | 4/1998 | Harrelson | |
| 5,740,582 | A | 4/1998 | Harrelson | |
| 6,058,560 | A | 5/2000 | Gab et al. | |
| 6,143,996 | A | 11/2000 | Skanda | |
| 6,158,080 | A | 12/2000 | Schlapkohl | |
| 6,182,327 | B1 | 2/2001 | Gosselin | |
| 6,427,284 | B1 | 8/2002 | Harrelson et al. | |
| 6,459,056 | B1 | 10/2002 | Graham | |
| 6,502,274 | B1 * | 1/2003 | Harrelson, II | A47L 5/38 15/352 |
| 6,817,058 | B1 | 11/2004 | Harrelson | |
| 6,948,527 | B2 | 9/2005 | Ragner et al. | |
| 7,010,829 | B2 | 3/2006 | Harman et al. | |
| 7,226,302 | B2 | 6/2007 | Walter et al. | |
| 7,231,686 | B1 * | 6/2007 | Matheney | A47L 7/009 15/313 |
| 7,306,012 | B2 | 12/2007 | Stockton et al. | |
| 7,363,679 | B2 | 4/2008 | Zimmerle et al. | |
| 7,640,620 | B2 | 1/2010 | Stockton | |
| 7,653,962 | B2 | 2/2010 | Gordon | |
| 7,793,384 | B1 | 9/2010 | Kerr | |
| 7,945,990 | B2 | 5/2011 | Gabric et al. | |
| 8,001,650 | B2 | 8/2011 | Trotter | |
| 8,479,353 | B2 | 7/2013 | Drivstuen et al. | |
| 8,590,098 | B2 | 11/2013 | Smith et al. | |
| 9,717,381 | B2 | 8/2017 | Harman | |
| 9,782,047 | B2 | 10/2017 | Nieschwitz et al. | |
| 9,808,135 | B2 | 11/2017 | Mantyla et al. | |
| 10,010,229 | B2 | 7/2018 | Drivstuen et al. | |
| 10,292,558 | B2 | 5/2019 | Graves | |
| 2001/0022009 | A1 | 9/2001 | Spearman | |
| 2002/0013974 | A1 | 2/2002 | Gibson et al. | |
| 2002/0069477 | A1 | 6/2002 | Smith et al. | |
| 2005/0018322 | A1 | 1/2005 | Ben-Gad et al. | |
| 2005/0022329 | A1 | 2/2005 | Harman et al. | |
| 2005/0028493 | A1 * | 2/2005 | Small | B65B 31/041 53/510 |
| 2005/0246854 | A1 | 11/2005 | Stockton | |
| 2005/0246855 | A1 | 11/2005 | Stockton et al. | |
| 2006/0179600 | A1 * | 8/2006 | Maurer | A47L 9/0036 15/327.6 |
| 2007/0017057 | A1 * | 1/2007 | Zimmerle | A47L 7/0038 15/315 |
| 2007/0017059 | A1 | 1/2007 | Zimmerle et al. | |
| 2007/0157425 | A1 | 7/2007 | Battle | |
| 2007/0174991 | A1 | 8/2007 | Trotter | |
| 2007/0174992 | A1 | 8/2007 | Murray et al. | |
| 2008/0066252 | A1 | 3/2008 | Herron, Jr. | |
| 2009/0188072 | A1 | 7/2009 | Gabric et al. | |
| 2009/0188073 | A1 | 7/2009 | Gabric et al. | |
| 2010/0024152 | A1 | 2/2010 | Drivstuen et al. | |
| 2012/0304414 | A1 | 12/2012 | Harman | |
| 2014/0259509 | A1 | 9/2014 | Harman | |
| 2014/0259517 | A1 | 9/2014 | Andrews | |
| 2015/0047144 | A1 | 2/2015 | Coesel | |
| 2016/0242612 | A1 * | 8/2016 | Graves | A47L 9/0036 |

FOREIGN PATENT DOCUMENTS

| | | | |
|---|---|---|---|
| CA | 908915 | A | 9/1972 |
| CA | 2258557 | C | 12/1997 |
| GB | 2048428 | A | 12/1980 |
| KR | 101322574 | B1 | 1/2012 |
| WO | 2001/24677 | A1 | 4/2001 |
| WO | 2002/071910 | A1 | 9/2002 |

OTHER PUBLICATIONS

CordAway Grommet, Amazon, available Oct. 2, 2001, https://www.amazon.com/CordAway-Grommet-Flexible-Black-00209/dp/B000087K65 (Year: 2001).*

Hide-A-Hose Central Vacuum Systems, Retractable Hose Central Vacuum System Product Brochure (2016).

International Search Report and Written Opinion from PCT application PCT/US2016/019400 (dated May 3, 2016).

International Search Report from co-pending application PCT/US2021/035052 (dated Oct. 13, 2021).

* cited by examiner

VACUUM AND HOSE RETRACTION SYSTEM

FIELD OF THE INVENTION

The present invention relates to vacuum systems of use, and more particularly to vacuum apparatus and methods that include retractable suction hoses that are drawn into a chamber using pressure provided from a vacuum source.

BACKGROUND OF THE INVENTION

A typical vacuum cleaning system includes a vacuum hose connected to a single vacuum source that creates a vacuum inside the hose for sucking up trash and debris. In some systems this vacuum source may also provide suction to a chamber into which the vacuum hose may be retracted after use. During use, the hose may be pulled to a desired length from the chamber through a hose outlet port. In some existing systems, the hose may be temporarily secured in the port to prevent the hose from retracting into the chamber and to seal off the chamber from outside air. Once the operator is finished using the hose, port may be unsecured allowing the vacuum in the chamber to draw the hose back into the chamber.

Such systems are generally very limited with regard to the length of hose that may be used. These systems can also be difficult to use and/or prone to malfunction, as they require a complex, hand-operated valve assembly associated with the hose and port in order to open or close the opening in the chamber through which the hose extends. If a single vacuum source is connected to multiple such hose retraction systems, the overall suction in the system (and thus the suction at the end of the hoses) may be undesirably reduced when one or more hose retraction valves are opened. Traditional systems also typically provide only a low level of suction (some systems provide only about 140 mm) within the hose chamber, and thus at the hose outlet port for cleaning purposes. Systems with low levels of suction are inefficient for retracting the hose back into the hose chamber, and may not be capable of retracting longer hoses at all. Such systems are therefore not conducive to large applications (i.e., warehouses or large/multi-story residences), or for uses which require longer hose (i.e., greater than about 50 feet in length), since the low level of suction cannot draw the hose back in at all, or it cannot draw the hose in quickly or efficiently.

In other existing vacuum systems, retraction of the hose is not accomplished using a vacuum, but rather the hose is withdrawn from and retracted into the chamber via a mechanical means. Such mechanical means may include a gear box having toothed sprockets which interdigitate with ridges on the outer surface of the hose. However, such systems are not ideal, as the ridged hose can be excessively heavy, and if the hose is stepped-on or otherwise crushed, the ridges may be damages preventing it from properly engaging with the sprocket and affecting or preventing retraction using the gear box. For larger applications which require long hoses (i.e., greater than about 40 feet in length), a gear box system may be frustratingly slow in retracting the full length of the hose.

Therefore, there is a need in the market for a vacuum hose retraction system which is operable to use a strong partial vacuum (i.e., from about 150 mm H2O to about 4000 mm H2O) in the hose chamber in order to quickly and efficiently draw in a hose, and to do so without reducing suction in the primary vacuum system, particularly when multiple hose retraction systems are hooked up to the same primary central vacuum source.

SUMMARY OF THE INVENTION

The present invention provides improved hose retraction systems, mechanisms and methods of use for portable or stationary vacuum devices. Embodiments of the retractable hose systems of the present invention may be adapted for use with any new or existing fluid vacuum or suction device (air, water, gas) where it is desirable to retract a suction hose. Potential applications include without limitation vacuum systems for use in cleaning floors or other surfaces in homes, businesses or automobiles, as well as other situations where vacuum hoses may be deployed for suction of fluids such as without limitation medical apparatus, dental apparatus, swimming pools, gardening, exhaust ducting, and the like. Embodiments of the present invention may also be adapted for use with other retractable items such as electrical cords and the like.

Embodiments of the present invention may include a housing having a large interior chamber or plenum into which an elongated hose may be retracted through an opening or port between the chamber and the exterior. In embodiments of the invention, the large chamber is in communication with a first vacuum source that is used to retract the hose into the large chamber. A second vacuum source may be provided for creating suction inside the hose itself. The two vacuum sources are each provided in their own separate chambers, which prevents operation of one of the vacuum devices from discharging debris into the chamber of the other vacuum device (e.g., through the non-operating vacuum device itself) which may cause clogging and other problems. Embodiments of the invention also include an electronic control located at the distal end of the hose for controlling operation of both vacuum sources. Some embodiments allow for electronic components such as rotating brushes or lights to be attached at the distal end of the hose and operated using the electronic control.

In some implementations the hose chamber of the present system may be operable to accommodate a much longer hose than current hose retraction systems, which typically are only operable to accommodate one or two loops (i.e., less than 20 feet) of hose. The second vacuum source provided in embodiments of the present invention allows for the use of hoses as long as sixty feet (60'). Embodiments of the present system may be stationary or portable. Stationary embodiments may be provided in such locations as, without limitation, a garage or storage area, integrated into a wall of a building in which the embodiment is used, under a bed, between a washer and dryer, or other similar locations. Portable embodiments may be provided with wheels and moved around during use, and then stored in a convenient location. Both stationary and portable systems are preferably shaped and dimensioned to provide a large hose chamber in order to accommodate housing hoses of great length of sixty feet or more.

The vacuum systems disclosed herein do not require a mechanical winding mechanism, nor a complex, hand-operated valve system at the hose outlet port in order to control the vacuum in the retraction chamber. The present systems also avoid a drop in suction at the ends of multiple hoses attached to a central vacuum source in order to retract one or more such hoses.

In some implementations, an independent vacuum motor (i.e., separate from the primary vacuum source which provides suction within the hose), that is connected only to the hose chamber (whether internal or external, directly or indirectly) may provide vacuum suction sufficient to quickly and efficiently retract the hose through the hose outlet port and into the chamber, regardless of the length of the hose. The system may be operable to draw the hose into the hose chamber without any guides, windings, or sleeves for gathering the hose within the chamber, although embodiments of such systems may include such elements. One such embodiment may include a hose intake deflector.

In other implementations, the systems of the present invention may include a single vacuum source, and a suction valve operable to switch suction via the single vacuum source from only creating negative pressure inside the hose to only creating negative pressure inside the hose chamber. In some embodiments, the suction valve may be controlled by a switch located at a distal end of the hose.

Embodiments of the invention may be portable or stationary. Stationary cleaning systems may include a fixed-position hose chamber and a hose of a sufficient length that allows the operator to vacuum large buildings, areas, etc. (e.g., homes, warehouses of 10,000 square feet or greater, etc.) without having to move the unit. Such stationary systems can be simply placed in an appropriate area (e.g., a closet, in corner of a laundry room, under a bed, etc.). Other applications for stationary systems may include dental offices, medical facilities, swimming pools, and the like where a hose is used for defined purpose after which it needs to be retracted to be out of the way. Other embodiments include portable models (e.g., upright and wheeled, backpack, or carried versions) that can be moved from area to area. Embodiments of the system of the present invention may comprise a power source operable to plug into a standard electrical outlet of the building in which it is used. Still further embodiments may include systems having elongated hoses located in portable chambers or plenums (such chambers having a retraction vacuum) that can be connected to a whole-house vacuum system, which supplies the negative pressure inside the hose.

Stationary embodiments of the present system may or may not comprise an on-board primary vacuum source and debris collection chamber. In most portable embodiments, and without limitation, the present invention relates to a portable apparatus having a first on-board vacuum source for retracting the hose; a hose chamber for storing the hose; a second on-board vacuum source for providing suction to the interior of the hose; and a hose outlet port through which the hose can be drawn into or out of the hose chamber. In other portable embodiments wherein the system does not include an on-board primary vacuum source, the primary vacuum source may comprise a central vacuum source of the building in which the present system is utilized. In such systems, the present systems may or may not comprise an onboard debris collection chamber in the suction path of the primary vacuum source, the debris collection chamber comprising a filter for preventing debris from exiting the debris collection chamber toward the primary vacuum source. However, in most embodiments, an on-board primary vacuum source is provided that is housed in a separate chamber (i.e., a primary vacuum source chamber), the separate chamber being in communication with the proximal end of the hose via the hose connector. In some embodiments, the separate chamber may further comprise the debris collection chamber.

In other embodiments, and without limitation, the present invention relates to a portable apparatus for connection to an external vacuum source (such as a central vacuum system) the apparatus including a hose; a hose chamber for storing the hose; a hose connector mounted on a wall of the hose chamber, the hose connector being for connecting a proximal end of a connecting hose to an external vacuum source; a hose outlet port through which the hose can be drawn into or out of the hose chamber, and an independent vacuum source operable to create a partial vacuum in the hose chamber, the partial vacuum being sufficient to quickly and efficiently draw the hose into the hose chamber. Such embodiments may comprise an onboard debris collection chamber in the suction path of the primary vacuum source. In some embodiments, the debris collection chamber may comprise a filter for preventing particles and debris collected therein from exiting the chamber and entering the primary vacuum source. In other embodiments, the debris collection chamber may be located downstream of the present system, as part of a central vacuum system.

Embodiments of the present invention may include a hose chamber having a hose outlet port, a hose having a proximal end connected to a primary vacuum source and a second end located outside the hose chamber, and a secondary independent vacuum source connected to the hose chamber and operable to create a partial vacuum (i.e., negative air pressure) in the chamber. The hose may be drawn into the hose chamber by negative air pressure created in the hose chamber by the secondary vacuum source when the secondary vacuum source is operating. When the hose is drawn into the hose chamber, air is drawn though the hose outlet port around the outer surface of the hose. The hose may, but need not tightly fit through the outlet port. A looser fit will allow the hose to travel through the port more readily, but will require the primary vacuum source to have a stronger suction to retract the hose. When the secondary vacuum source is not operating air may be drawn only through a distal end of the hose, facilitating a cleaning operation of the system.

Embodiments of the second independent vacuum source may comprise a motor or other suitable mechanism operable to create a partial vacuum (i.e., from about 150 mm H2O to about 4000 mm H2O of negative air pressure) in the hose chamber, the partial vacuum being sufficient to draw the hose into the hose chamber via the hose outlet port. In some embodiments, the secondary vacuum source may comprise at least one vacuum motor housed in a separate chamber (i.e., an independent vacuum source chamber), the separate chamber being in communication with the hose chamber via a port or valve, and operable to move a volume of air from inside the hose chamber to an exhaust port of the secondary vacuum source.

In other embodiments, the system may not comprise an independent vacuum source, and instead may comprise a suction valve for switching a suction path coming from a first position allowing the primary vacuum source to create negative pressure inside the hose itself, to a second position creating negative pressure inside the hose chamber. Embodiments of such a suction valve may be in electronic communication with the switch located at the distal end of the hose, as further described herein. In some embodiments, the suction valve may comprise a switch valve operable to provide fluid communication between either the primary vacuum source and the proximal end of the hose, or between the primary vacuum source and the hose chamber. In some embodiments, the suction valve may comprise an electronic valve having a solenoid for actuating the valve. The system may therefore not reduce the overall suction of the primary vacuum source while drawing the hose into the hose chamber, as the suction normally provided to the hose is simply diverted to the hose chamber.

In some embodiments, the independent secondary vacuum source may comprise a plurality of vacuum motors working in concert to create negative pressure in the hose chamber. It is to be understood that such embodiments include a plurality of motors in order to increase the suction capacity of the hose chamber for the purpose of retracting the hose.

The hose chamber may comprise any inner shape operable to house a suitable length of hose. In some embodiments, the hose chamber may comprise a substantially rectangular prism shape. In other embodiments, the chamber may comprise a substantially cylindrical shape. The hose chamber may be substantially airtight except for a vacuum inlet port leading to the secondary vacuum source, and the hose outlet port leading out of the chamber. In some embodiments, the secondary vacuum source may be housed within the hose chamber, where the vacuum inlet port is integral with the secondary vacuum source. In other embodiments, the secondary vacuum source may be located outside the hose chamber, and the vacuum inlet port is in fluid communication with the secondary vacuum source. In some embodiments, the secondary vacuum source may be located remote from the hose chamber, and may be in fluid communication therewith via a duct.

Embodiments of the vacuum inlet port may be preferentially, but not necessarily, located at an upper wall of the hose chamber. In other embodiments, such as those that fit under a bed, the inlet port may be provided on a side wall of the housing. In some embodiments, the vacuum inlet port may comprise a filter operable to filter particles from the air being drawn into the vacuum inlet port. In other embodiments, the filter may be located downstream of the secondary vacuum source, or may be a component of the secondary vacuum source (i.e., integral to and/or located within the secondary vacuum source).

The walls of the hose chamber may comprise any material operable to support the partial vacuum inside the chamber, as well as the weight of the hose, and in some embodiments, the weight of the secondary vacuum chamber. In some embodiments, the walls of the chamber may comprise at least one of a wood, a metal, a metal alloy, a plastic, carbon fiber, graphene, and the like. In some embodiments, the walls of the hose chamber may comprise at least one of a single pane, dual panes, triple panes, or a combination thereof.

Embodiments of the hose outlet port may comprise a shape and dimension(s) complementary to a cross-sectional shape and dimension(s) of the hose. In some embodiments, the hose outlet port may comprise a substantially circular shape and an inner diameter slightly greater than an outer diameter of the hose. The hose outlet port may thereby be operable to create a small, substantially regular distance between an inner surface of the hose port and an outer surface of the hose. This arrangement may cause air being sucked into the hose outlet port to interact with the outer surface of the hose, irrespective of whether the hose comprises outer ridges (which may be provided in some embodiments), providing a suction force on the outer surface of the hose in the direction of the hose chamber. The suction force may thereby pull the hose into the hose chamber unless overcome by a greater opposing force (i.e., a user holding the second end of the hose, or a stop of the second end of the hose interacting with the hose port). In some embodiments, the hose outlet port may comprise a collar (e.g., a grommet shape) for lining the inner wall of the hose outlet port. Such a collar may comprise a smooth surface (i.e., a smooth plastic or metal surface) for providing a low-friction interaction with the outer surface of the hose as it is retracted into the hose chamber. In some embodiments, the system may comprise a plurality of removable and replaceable collars, each comprising a different inner diameter (i.e., each having an inner wall with a different thickness) for use with different sized hoses and/or for increasing or decreasing the friction between the hose and the collar, depending on the desires of the user.

In other embodiments, the collar may comprise a reducing mechanism operable to change the inner diameter of the collar. In some embodiments, the reducing mechanism may comprise an elastic ring, or a bendable C-shaped member having a plurality of stops for engaging the ends of the C together to create different inner diameters. In other embodiments, the reducing mechanism may comprise a plurality of overlapping inner blades arranged circumferentially, wherein an angle of the plurality of blades defines the shape and/or dimension(s) of the inner surface of the collar (similar to a camera iris). Thus, adjusting a position of the plurality of blades may reduce or increase the inner diameter of the collar.

In accordance with these embodiments, changing from a first collar with a first inner diameter to a second collar with a second inner diameter, or adjusting the inner diameter of the collar via a reducing mechanism, may alter the distance between the inner surface of the collar and the outer surface of the hose, increasing or decreasing the suction force on the outer surface of the hose. Changing the collar may also be useful if the hose needs to be replaced, and the replacement hose is either longer or has a different outer diameter from the prior hose.

In some embodiments the system may further include a hose guide connected to the hose outlet port, wherein the hose is drawn through the hose guide when it is pulled into or out of the hose chamber. The hose guide may include a tube having a plurality of perforations operable to assist in creating the suction pressure around the outer surface of the hose as it is drawn into the hose chamber.

The hose may comprise a proximal end, a distal end, and a length, the proximal end comprising an airtight connection with a hose connector, the vacuum hose connector being mounted to an inner wall of the hose chamber and being in fluid communication with the primary vacuum source, either directly or indirectly. The primary vacuum source may be in a separate chamber. The hose length may comprise any length appropriate for vacuuming an area of a residence, commercial, or industrial structure. In some embodiments, the length may be sufficient for a single hose retraction system to cover a large internal area of a warehouse. In some embodiments, the length may be in a range from about 5 feet to about 100 feet, or any length or range of lengths there between (i.e., about 10 feet, about 15 feet, about 20 feet, about 25 feet, about 30 feet, about 35 feet, about 40 feet, about 45 feet, about 50 feet, about 55 feet, about 60 feet about 65 feet, about 70 feet, about 75 feet, about 80 feet, about 85 feet, about 90 feet, or about 95 feet). In a preferred embodiment, the length may comprise about 50 feet.

Embodiments of the distal end of the vacuum hose (handle) may comprise one or more switches, one or more accessory connectors, and/or stop(s). In some embodiments, the switch(es) may be operable to perform one or more of the following tasks: activate or deactivate the primary vacuum source; activate or deactivate the independent secondary vacuum source; turn on and turn off a motor of the primary vacuum source; turn on or off a motor of the secondary vacuum source; operate a solenoid; open or close a gate and/or a duct in fluid communication with a remote independent or primary vacuum source; provide power to the end of the hose to operate an attachment (such as a motorized brush or a light); etc. In some embodiments, the switch(es) may comprise analog switch(es) (i.e., similar to a light switch) or digital electronic switch(es) (i.e., a touch screen). In some embodiments, the hose may comprise one or more wires running along the hose, preferably incorporated into corrugations of the hose, from the switch(es) to one or both of the vacuum sources. In other embodiments, the switch(es) may be in wireless communication with one or both of the vacuum sources.

Embodiments of an accessory connector of the handle may comprise any mechanism operable to attach a vacuum accessory (i.e., a narrow end, a brush end, a rotating brush end, and the like). In some embodiments, the accessory connector may comprise a mildly tapering cylindrical shape wherein an outer diameter of the accessory connector decreases at the distal end thereof.

Embodiments of the stop may comprise any mechanism operable to prevent the distal end (handle) of the hose from being retracted through the hose outlet port and into the hose chamber. In some embodiments, the stop may comprise a large handle with hand grip, or a circular extension operable to increase the outer diameter of the distal end such that it is greater than an inner diameter of the hose outlet port. In some embodiments, the collar may comprise a flared receiver that surrounds a portion of the hose outlet port, and the stop may comprise a conical shape that is complementary to the flared receiver.

Embodiments of the switch may comprise a plurality of settings. In some embodiments, exemplary settings may include a vacuum setting (i.e., wherein the primary vacuum source is activated and the secondary vacuum source is not activated) and a retraction setting (i.e., wherein the primary vacuum source is not activated and the independent vacuum source is activated). In other embodiments such as those where the primary vacuum source comprises an external vacuum source, the retraction setting may not affect the primary vacuum source, but may engage the secondary vacuum source. In some embodiments, the switch may further comprise an "off" setting (i.e., wherein neither the primary vacuum source nor the independent vacuum source is engaged). In some embodiments, the plurality of settings may further comprise a setting wherein both the primary vacuum source and the secondary vacuum source are engaged.

In other embodiments, wherein the system comprises the suction valve rather than the independent vacuum source, the switch may comprise, for example, a vacuum setting (i.e., wherein the primary vacuum source is engaged and the suction valve provides fluid communication from the primary vacuum source to the proximal end of the hose); or a retraction setting (i.e., wherein the primary vacuum source is engaged and the suction valve provides fluid communication from the primary vacuum source to the hose chamber). In some embodiments, the switch may further comprise an "off" setting (i.e., wherein the primary vacuum source is not engaged).

In situations where the secondary vacuum source is not engaged, the hose chamber may not comprise a partial vacuum, and the hose may pass freely through the hose outlet port. When the secondary vacuum source is engaged, the hose chamber may comprise the partial vacuum (e.g., negative air pressure in a range from about 150 mm H2O to about 4000 mm H2O) sufficient to quickly and efficiently retract the hose into the hose chamber until the stop engages with the hose outlet port.

Embodiments of the system may further comprise a debris collection chamber. The debris collection chamber may be operable to collect particles and debris sucked into the hose during a vacuuming session. In some embodiments, the debris collection chamber may comprise a chamber which is sealed except for a first opening in fluid communication with the vacuum hose connector of the hose chamber, and a second opening in fluid communication with an inlet of the primary vacuum source. In some embodiments, the debris collection chamber may include a filter that prevents the passage of collected debris from passing from the debris collection chamber into the primary vacuum source.

It is to be understood that there are several variations in the vacuum systems of the present invention, and that the foregoing descriptions of various embodiments of the methods and apparatus of the present invention have been presented for purposes of illustration and description. They are not intended to be exhaustive or to limit the invention to the precise forms disclosed, and many modifications and variations are possible in light of the teachings herein.

It is an object of the present invention to provide hose retraction systems that are operable to retract a hose of the system efficiently after an operator has completed use of the system.

It is an object of the present invention to provide hose retraction systems that retract a hose into a chamber or plenum of the system using negative pressure created by an internal or external vacuum source.

It is an object of the present invention to provide hose retraction systems that reduce the effort required to deploy, operate, and retract the vacuum system.

It is also an object of the present invention to provide portable or stationary hose retraction systems in a single compact unit that includes a hose, a hose chamber for storing the hose, a port in the hose chamber through which the hose passes, a first vacuum source in a first separate chamber that is in communication with the interior of the hose, a second vacuum source in a second separate chamber that is in communication with the hose chamber such that which the first vacuum source provides suction inside the hose and the second vacuum source provides suction to retract the hose into the hose chamber through the port.

It is also an object of the present invention to provide portable or stationary hose retraction systems in a single compact unit that includes a hose, a primary vacuum source for the interior of the hose, a chamber for storing the hose, and either a second vacuum source in communication with the chamber, or a valve for switching suction from the primary vacuum source from the hose to the hose chamber, for creating negative pressure to retract the hose.

It is also an object of the present invention to provide hose retraction systems that manage and easily store and retract long hoses (i.e., about 60 feet in length) into a chamber in the system.

It is also an object of the present invention to provide hose retraction systems that include one or more switches at a distal end of the hose for electronically controlling the hose vacuum, hose retraction, and operation of electronic accessories at the distal end of the hose.

It is also an object of the present invention to provide hose retraction systems that include a movable robotic unit with a proximity generating signal at the distal end of the hose, whereby the robotic unit may withdraw the hose as needed during use, and the secondary vacuum source may retract slack in the hose during use, or may retract the entire hose and the robotic unit after use.

Additional aspects and objects of the invention will be apparent from the detailed descriptions and the claims herein.

DETAILED DESCRIPTION

Figure 1:
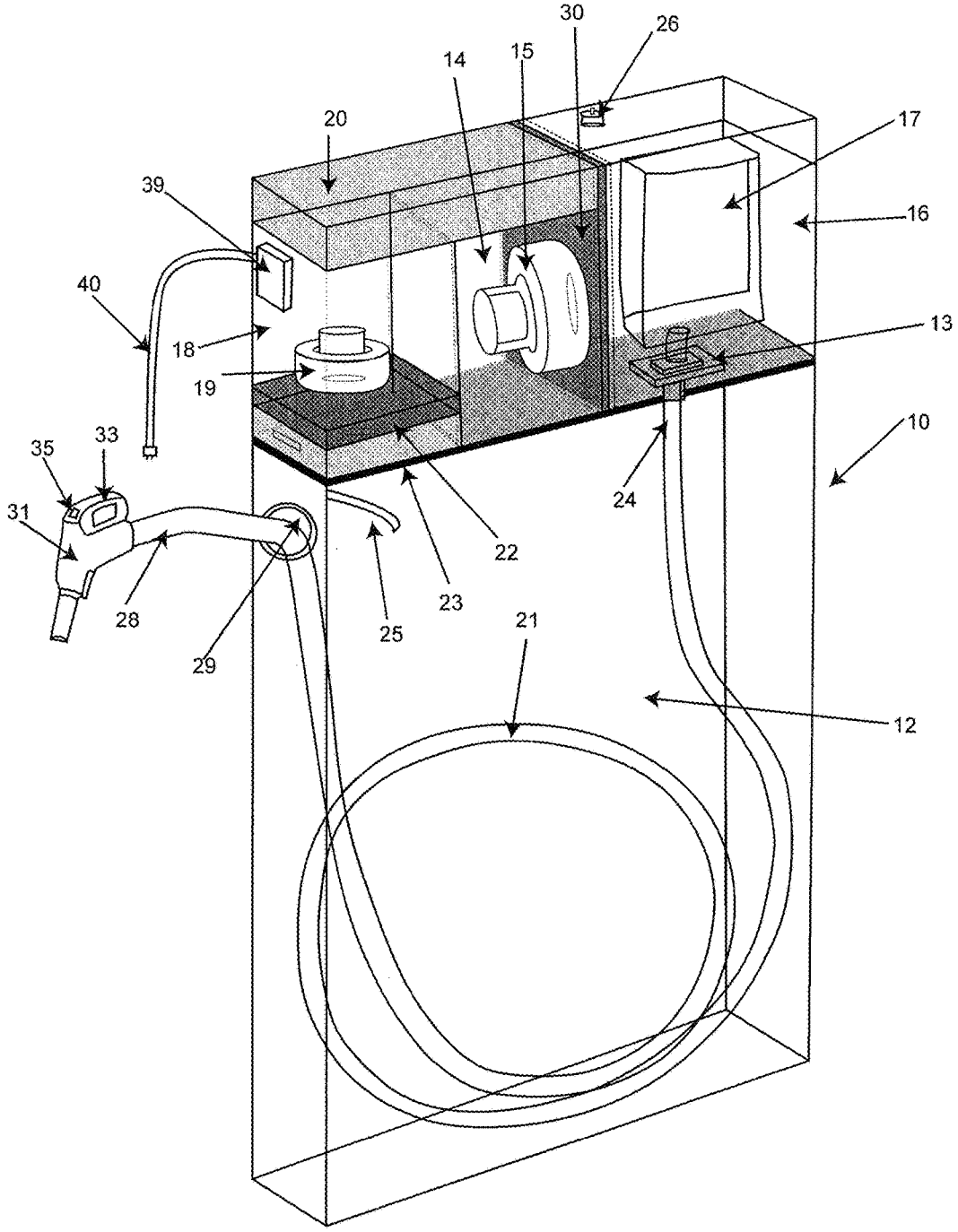
FIG. 1 is a perspective cut-away view of an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention.

Referring to the drawings wherein like reference characters designate like or corresponding parts throughout the several views, it is seen that the present invention includes various embodiments having a hose in communication with a first vacuum source for providing suction to the interior of the hose, a chamber for storing the hose, and a second vacuum source in communication with the chamber for retracting the hose. In most embodiments, the first vacuum source is provided in a first separate chamber and the second vacuum source is provided in a second separate chamber, such that the vacuum or discharge produced by either of the vacuum sources does not enter or affect the chamber of the other vacuum source.

Figure 1A:
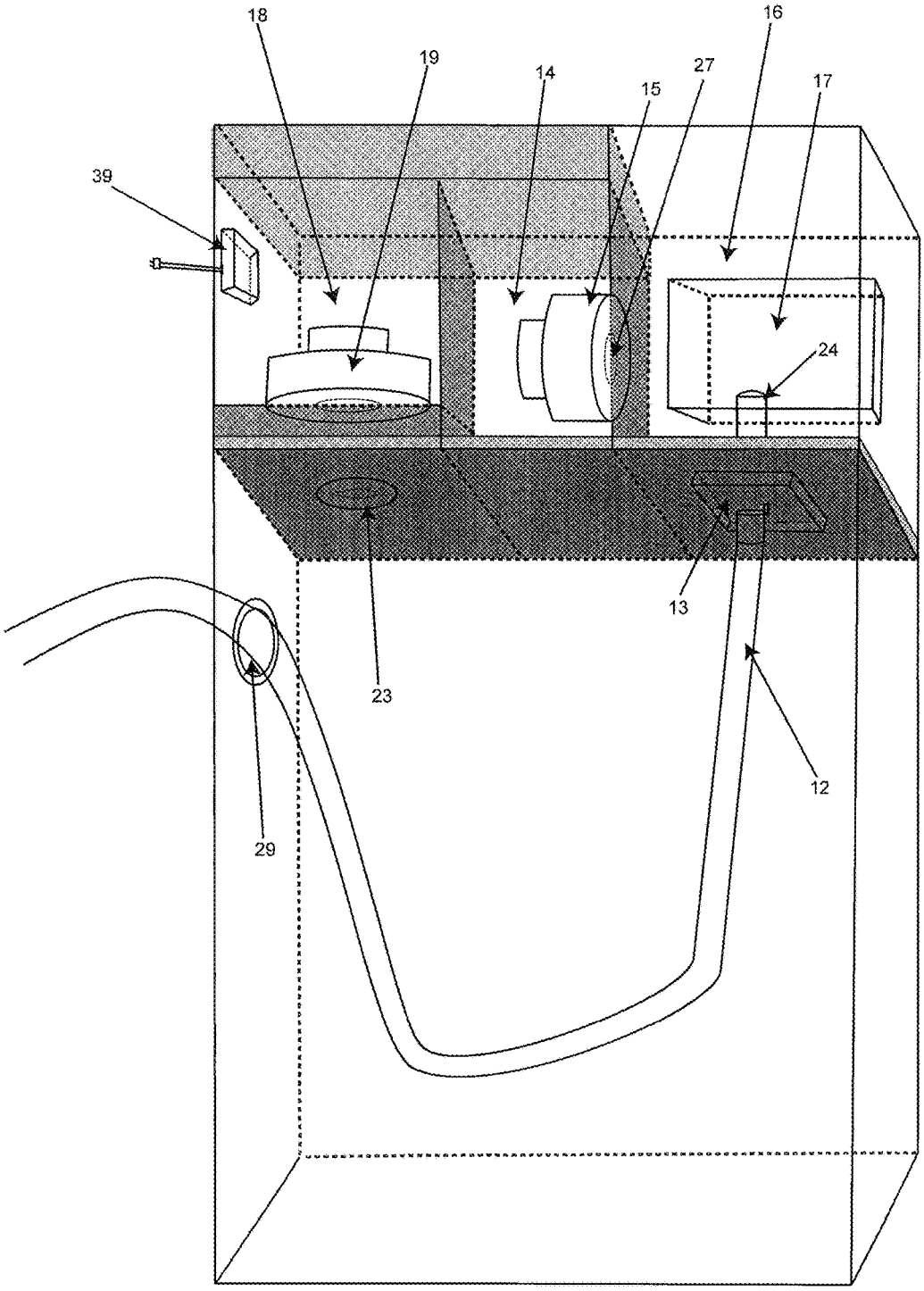
FIG. 1A is another perspective cut-away view of an embodiment of the present invention.

Referring to the exemplary embodiment of FIGS. 1 and 1A, it is seen that this embodiment of an apparatus of the present invention includes a housing 10 having a large hose storage chamber 12 in which a hose 21 is deployed. A port 29 is provided on housing 10 allowing for fluid communication between the interior and exterior of storage chamber 12. Hose 21 is movably deployed through port 29 allowing hose 21 to be pulled out of chamber 12 to the exterior, or retracted back through port 29 to the interior of chamber 12.

A first vacuum chamber 14 is provided adjacent to hose chamber 12. Chamber 14 contains a first vacuum source 15 which may be in the form of a vacuum motor. A debris collection chamber 16 is provided adjacent to chamber 14, in fluid communication with the first vacuum source 15 through opening 27. A filter 30 may be provided over opening 27 between chamber 16 and vacuum source 15. A hose coupling 13 is provided between the debris collection chamber 16 and the hose chamber 12. A proximal end 24 of hose 21 is connected through coupling 13 to debris collection chamber 16, and may extend into a breathable trash collection container or filter 17. It is to be appreciated that in this illustrated configuration, operation of vacuum source 15 causes air to be withdrawn through opening 27 from debris collection chamber 16 through hose 21 providing suction at the distal end 28 of the hose, such that debris may be collected at the distal end 28 and drawn into the trash collection container 17. An air relief valve 26 may be provided in chamber 16 in case hose 21 becomes clogged, so that vacuum 15 has an alternative source for air.

A second vacuum chamber 18 is provided adjacent to the hose chamber 12. Chamber 18 is separate from chamber 14 and from chamber 16, and contains a second vacuum source 19, which may also be in the form of a vacuum motor. An intake opening 23 is provided between the second vacuum chamber 18 and the hose chamber 12 allowing for fluid communication these two chambers. A filter 22 may be provided over opening 23 between hose chamber 12 and vacuum source 19. It is to be appreciated that in this illustrated configuration, operation of the second vacuum source 19 causes air to be withdrawn from hose chamber 12. This creates suction at port 29 causing hose 21 to be retracted into hose chamber 12. A deflector 25 may be provided to help guide hose 21 into chamber 12 during retraction.

Each vacuum chamber 16 and 18 should require an exhaust. In the illustrated embodiment, both chambers 16 and 18 use the same exhaust filter 20 because the chambers are adjacent to each other. It is to be appreciated that in different embodiments where chambers 16 and 18 are not adjacent to each other, each should have its own exhaust filter 20.

Hose 21 should be flexible, and may be of any suitable length or diameter, depending on the size of hose chamber 12 and the diameter of port 29. For example, and without limitation, chamber 12 may be large, allowing hose 21 to have a length of between thirty and sixty feet (30'-60'). In another example, and without limitation, chamber 12 may be smaller, limiting hose 21 to a length of between ten and twenty-five feet (10'-25'). It is to be appreciated that many different sizes of hose chambers 12 and many different lengths of hoses 21 are contemplated within the scope of the invention. Typical embodiments include hoses having a length in a range of about ten to about one hundred feet (10'-100') in length.

The strength of retraction vacuum 19 may be varied depending on the length of hose 21 and the size of chamber 12 so as to provide sufficient suction to retract hose 21 when suction is activated. For example and without limitation, a hose having a length of fifty feet (50') may be efficiently retracted using a vacuum 19 having a power of 3000 mm H2O. In different embodiments of the present invention, the retraction vacuum may have a strength ranging from 1000 mm H2O to 4000 mm H2O.

The outside diameter of hose 21 should be smaller than, but close to the inside diameter of port 29. In this way, when suction is applied to hose chamber 12 by the second vacuum source 19, the majority of the suction operates to retract the hose 21 and does not escape between the outside edge of hose 21 and the inside edge of port 29. Hoses with different diameters may be used and may vary depending on the length of the hose, the power of the suction applied to the hose and the suction needed to retract the hose, as well as other factors such as the size of debris that is expected to be drawn through the hose. A hose in a typical floor vacuum cleaner application may have a diameter of between about 1.25 inches and about 1.375 inches; in non-vacuum cleaning applications, the hose diameter may be anywhere from about ¼ inch to about six inches, depending on the application.

In some embodiments, the hose 21 may have peripheral external ribs or ridges having diameters which correspond very closely to (and which may frictionally engage) the inside diameter of the port 29. In these embodiments, the tight-fitting ribs help with retraction by causing the suction to be concentrated on the hose. In other embodiments, one or more grommets, clamps or other devices may be employed at port 29 to change its diameter. The diameter of port 29 may be increased to allow the hose 21 to more easily be pulled from the chamber 12, although these embodiments will either retract the hose more slowly, or require more suction to retract the hose more quickly. The diameter of port 29 may be decreased to allow the hose 21 to be more quickly retracted into chamber 12 using less suction.

Figure 2:
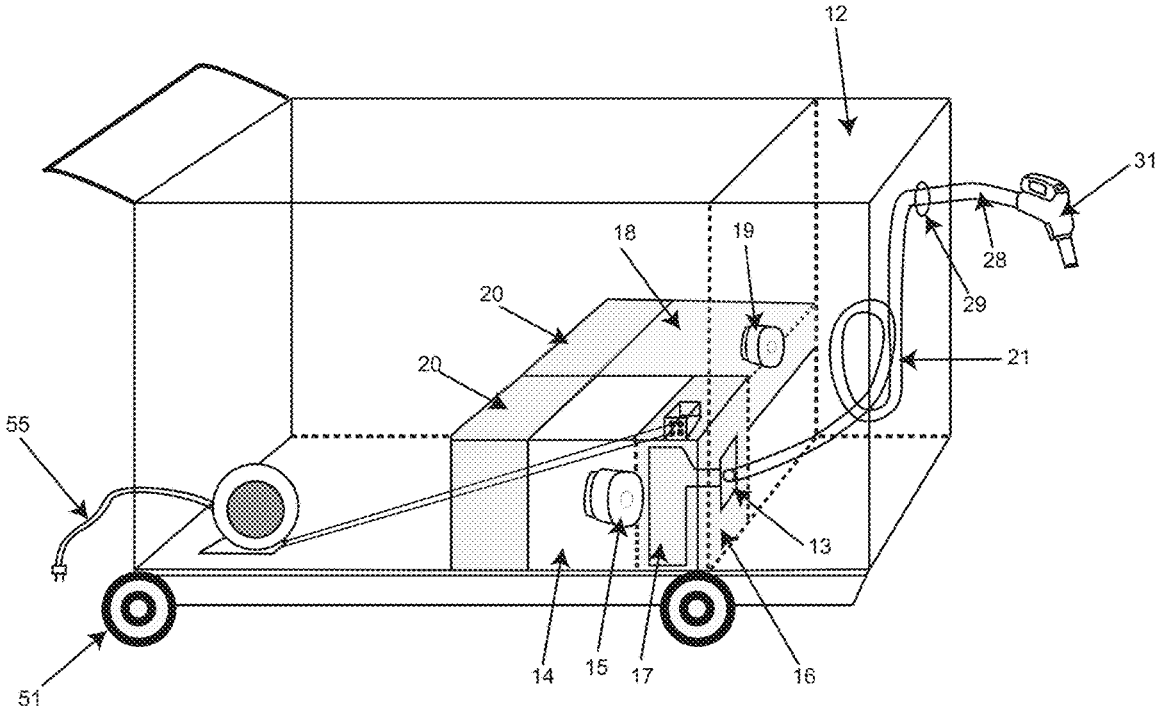
FIG. 2 is a side perspective cut-away view of an alternative mobile embodiment of the present invention.

The exemplary embodiment disclosed in FIG. 2 is mobile, being provided with wheels 51. In these embodiments, the unit is self-contained needing only external power to operate the electronic parts. A retractable electrical cord 55 is provided to allow the unit to be plugged into a wall outlet, and moved from place to place without losing power. It is to be appreciated that although the chamber 12 illustrated in FIG. 3 is relatively small, in other embodiments this chamber 12 may be much larger, in some cases large enough to hold a hose having a length of forty to sixty feet (40'-50'), with a correspondingly stronger second vacuum 19.

Figures 3A, 3B:
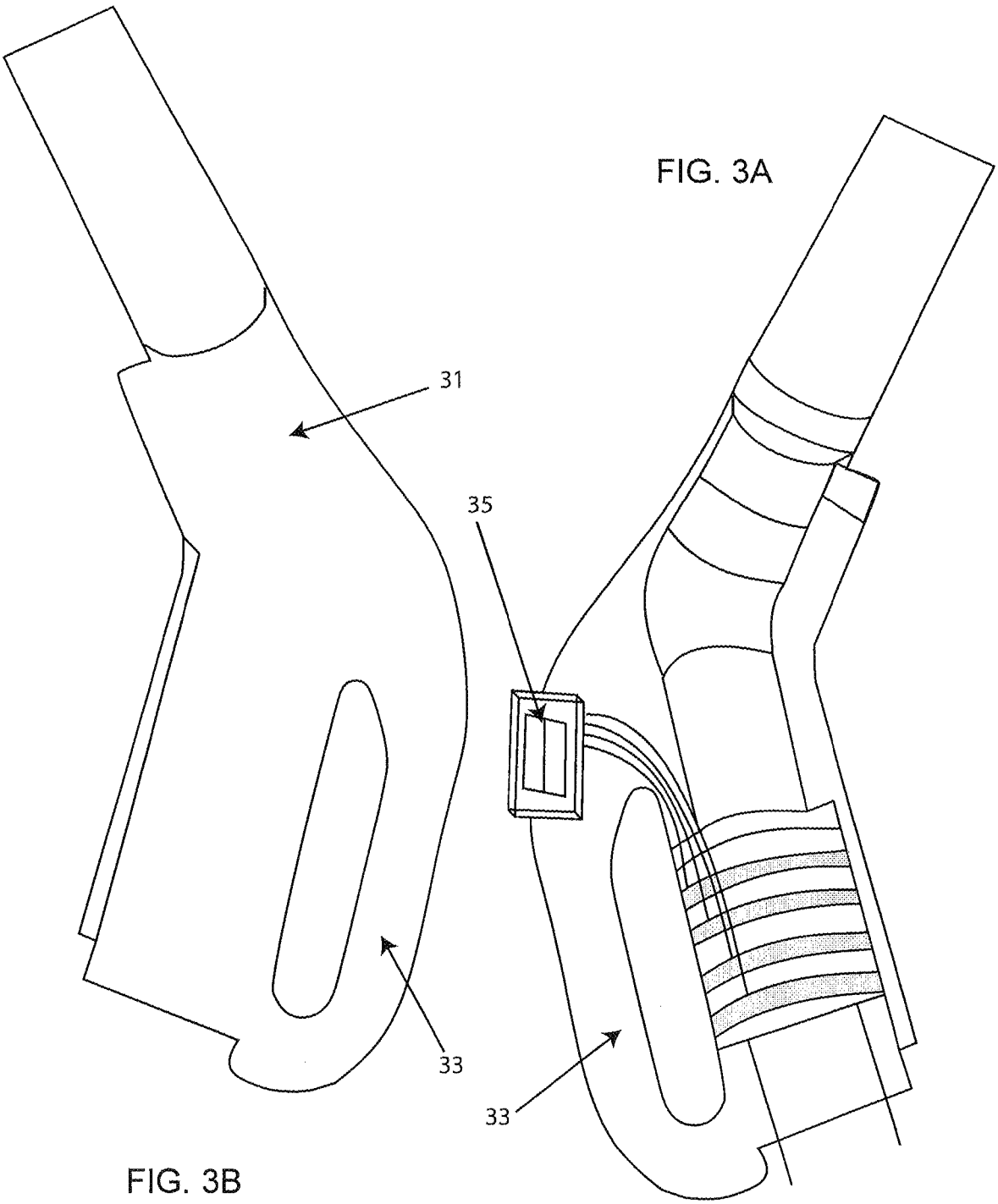
FIG. 3A is a bottom perspective view of an embodiment of a hose handle of an embodiment of the present invention.
FIG. 3B is a top perspective view of an embodiment of a hose handle of an embodiment of the present invention.

As shown in FIGS. 3A and 3B, a handle 31 may be provided at the distal end 28 of hose 21. Handle 31 may include a hand grip 33 and one or more switches 35 in communication with an electronic control 39. Switches 35 may be used to cause control 39 to operate the first vacuum source and/or the second vacuum source. Additional switches may be provided on handle 31 to control other aspects of the invention, including without limitation accessories such as, without limitation, a rotating brush or a light 38 that may be attached to handle 31. In some embodiments, the switch(es) 35 on handle 31 may be used to operate a valve for alternating a single suction source from inside the hose (for cleaning) to inside chamber 12 (for retraction) shown in FIG. 7.

Figure 4:
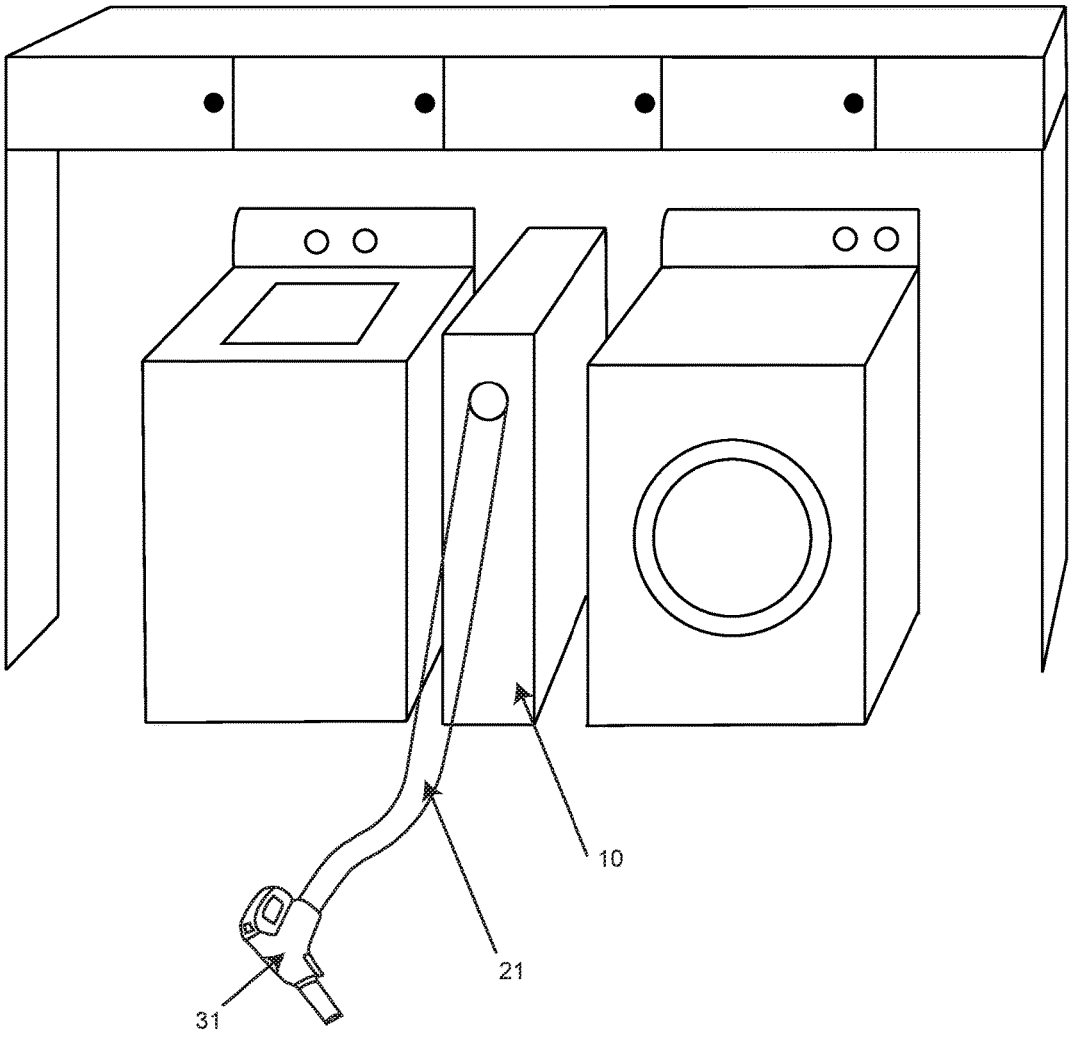
FIG. 4 is an environmental view showing a possible location of an embodiment of the invention.

The embodiment shown in FIG. 4 is somewhat portable in that it is not built into a wall, but may be retrofit into an existing space such as the illustrated gap between a washer and dryer. Other suitable locations may be under a bed, in a closet, in an attic space, or in a garage. This unit may then be plugged into a wall outlet to provide power to the vacuums and other electronic components. It is to be appreciated that by providing a stronger second vacuum motor, a large chamber may be provided allowing for the use of a lengthy hose (up to 100') for such applications.

Figure 5:
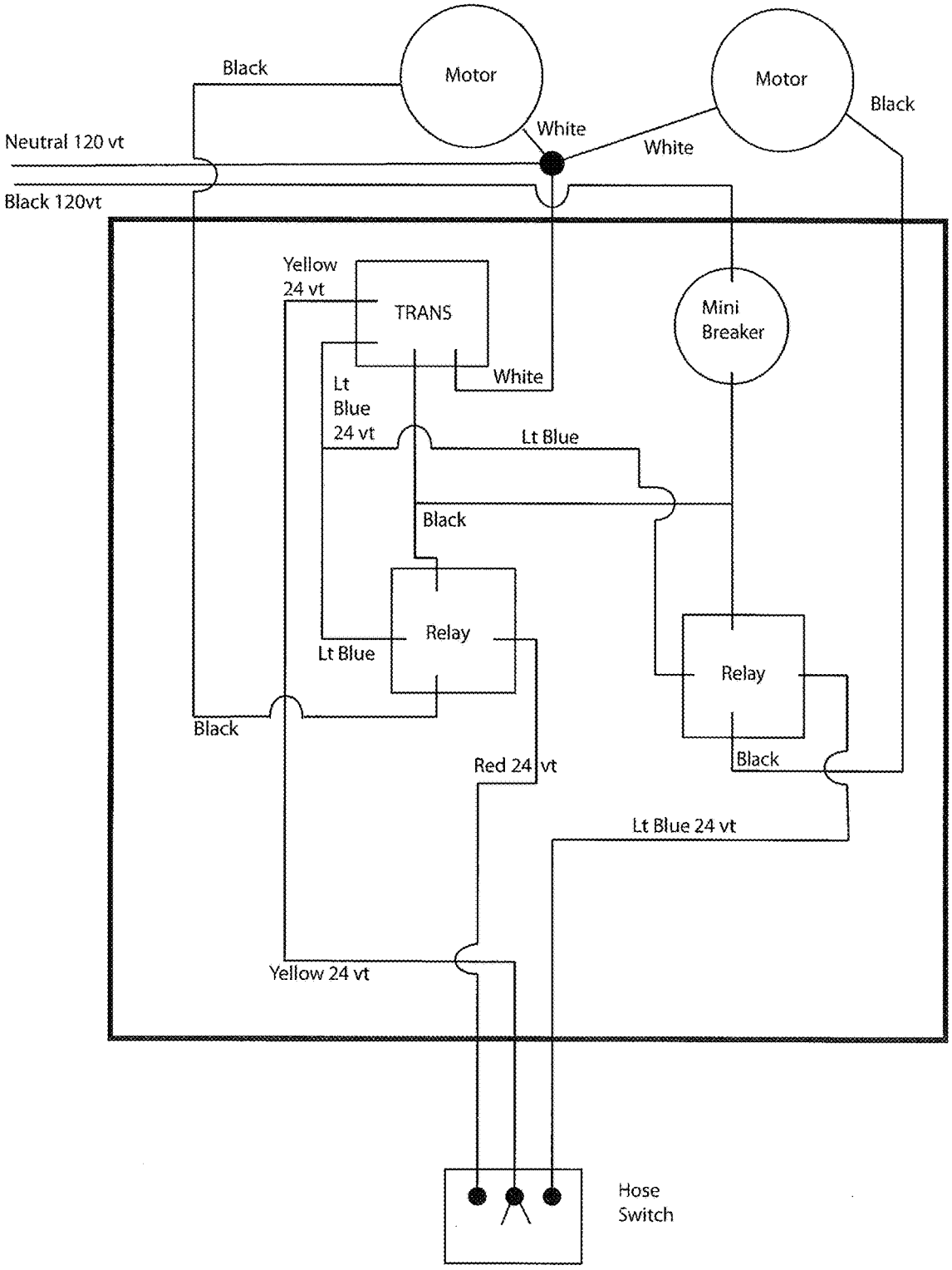
FIG. 5 is an exemplary circuit for an electronic control of an embodiment of the present invention.

FIG. 5 shows an exemplary schematic of an electronic control 39. In these embodiments, one or more switches 35 may be provided at the handle 31 or grip 33 for easy access by a user. In this illustrated embodiment, most of the control circuitry is provided at a central location 39 on housing 10, which may receive power through cord 40 that may be plugged into a local power source. Switch(es) 35 may be used to operate the first vacuum motor 15 (to provide suction to the inside of the hose) or the second vacuum motor 19 (to retract the hose). In other embodiments not illustrated here, one or more additional switches may be provided to operate such things as, without limitation, one or more rotating brushes, one or more lights, or other desirable electronic attachments. It is to be appreciated that other non-electronic attachments may also be provided, such as, without limitation, a narrow suction knife, a smaller vacuum opening, non-rotating brushes, and the like.

Figure 6:
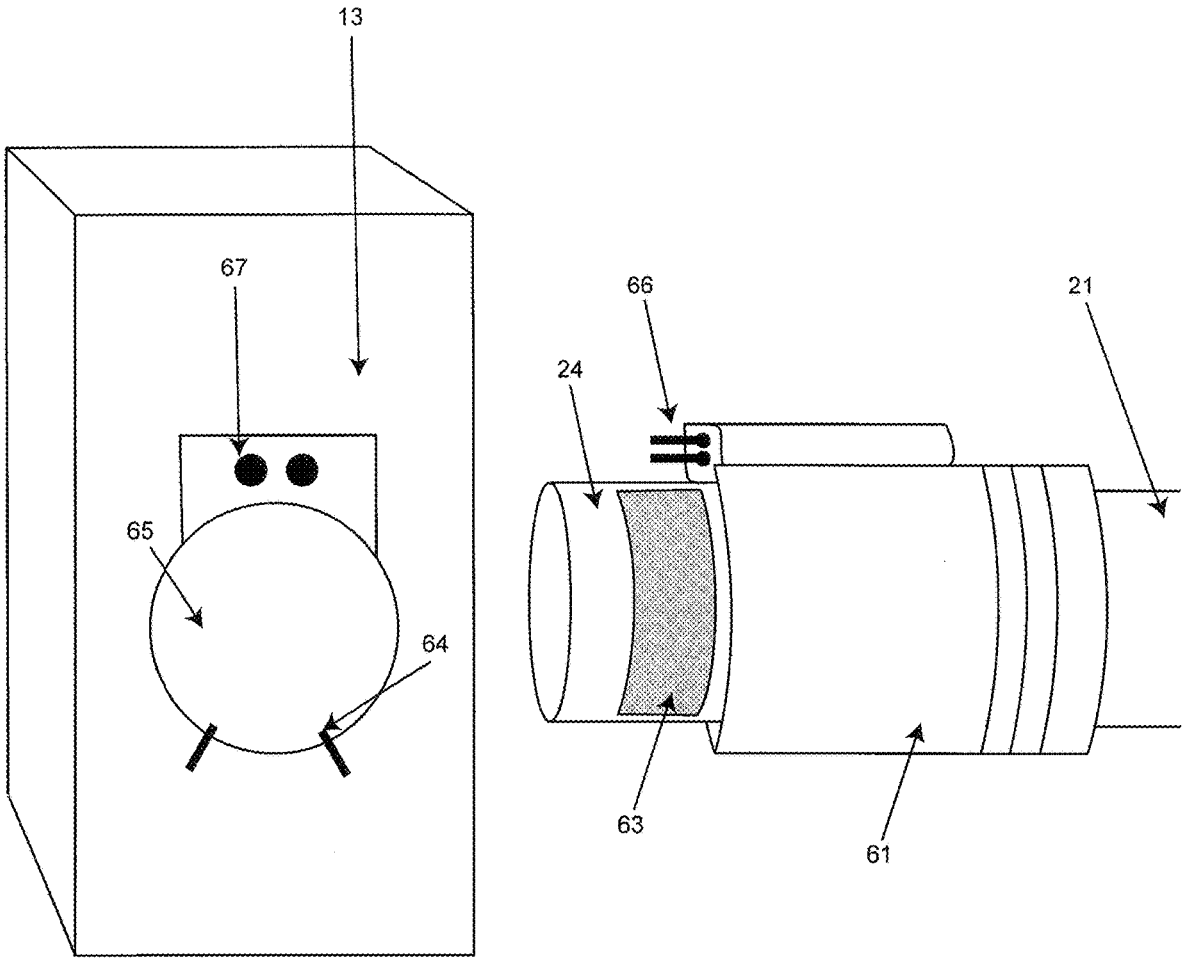
FIG. 6 is a disconnected view showing how an embodiment of a hose of the present invention may be engaged.

FIG. 6 shows an embodiment of a connection between an exemplary proximal end 24 of a hose 21 and an exemplary coupling 13. In this illustrated embodiment, the proximal end 24 of hose 21 is provided with a sleeve or coupling 61 which provides one or more electrical connections. In the illustrated embodiment, one or more first connections may be provided on sleeve 61 in the form of conductive prongs 66 that engage with complementary conductive receptors 67 on coupling 13. In some embodiments, high voltage may be transmitted through these first conductors, although they may also be used for low voltage. In this illustrated embodiment, one or more second connections may be provided on sleeve 61 in the form of one or more conductive surfaces 63 which make contact with one or more complementary conductive contacts 64 positioned in opening 65 of coupling 13. In some embodiments, low voltage may be transmitted through these second conductors, although they may also be used for high voltage.

Figure 7:
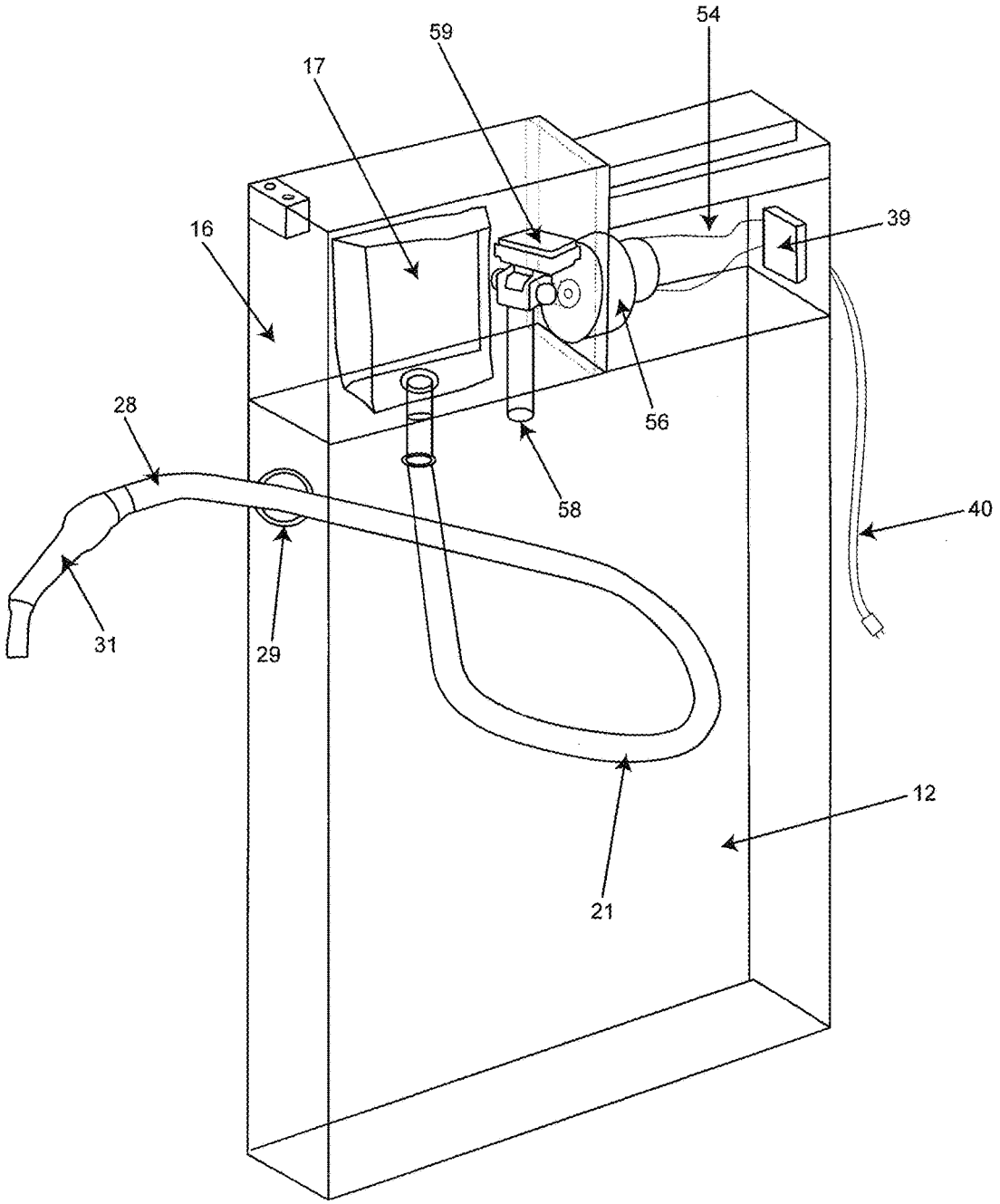
FIG. 7 is a perspective cut-away view of another embodiment of the present invention.

FIG. 7 illustrates an alternative embodiment having only one vacuum source, and a valve that is used to switch the vacuum source from either providing suction to the hose, or retracting the hose. As shown in FIG. 7, these embodiments include a single vacuum source 56 provided in a chamber 54. A controllable valve unit 59 is provided at the intake of vacuum source 56. Valve 59 may be activated to operate in one position so as to draw fluid into chamber 16, through collection container 17, and through hose 21 for cleaning purposes. Valve 59 may alternatively be activated to operate in another position so as to draw fluid through pipe 58 which extends into chamber 12 for retracting hose 21 into chamber 12. Valve 59 may be operated by one or more switches 35 at the distal end 28 of hose 21.

Other embodiments may include a proximity sensor on housing 10 that receives a signal generated by a transmitter at the distal end 28 of the hose. Electronic circuitry and programming associated with the proximity sensor is capable of determining where the distal end 28 of the hose is located (position) in relation to the housing, as well as the amount of hose that has been withdrawn from the housing. With this information, the programming and circuitry is capable of determining how much hose is needed, and may periodically operate a retraction vacuum motor 19 (or adjust valve 59 for retraction) to briefly draw in unneeded or extra lengths hose. It is to be appreciated that some hose slack may be allowed in these embodiments to provide freedom of movement at the distal end of the hose.

Figure 8A:
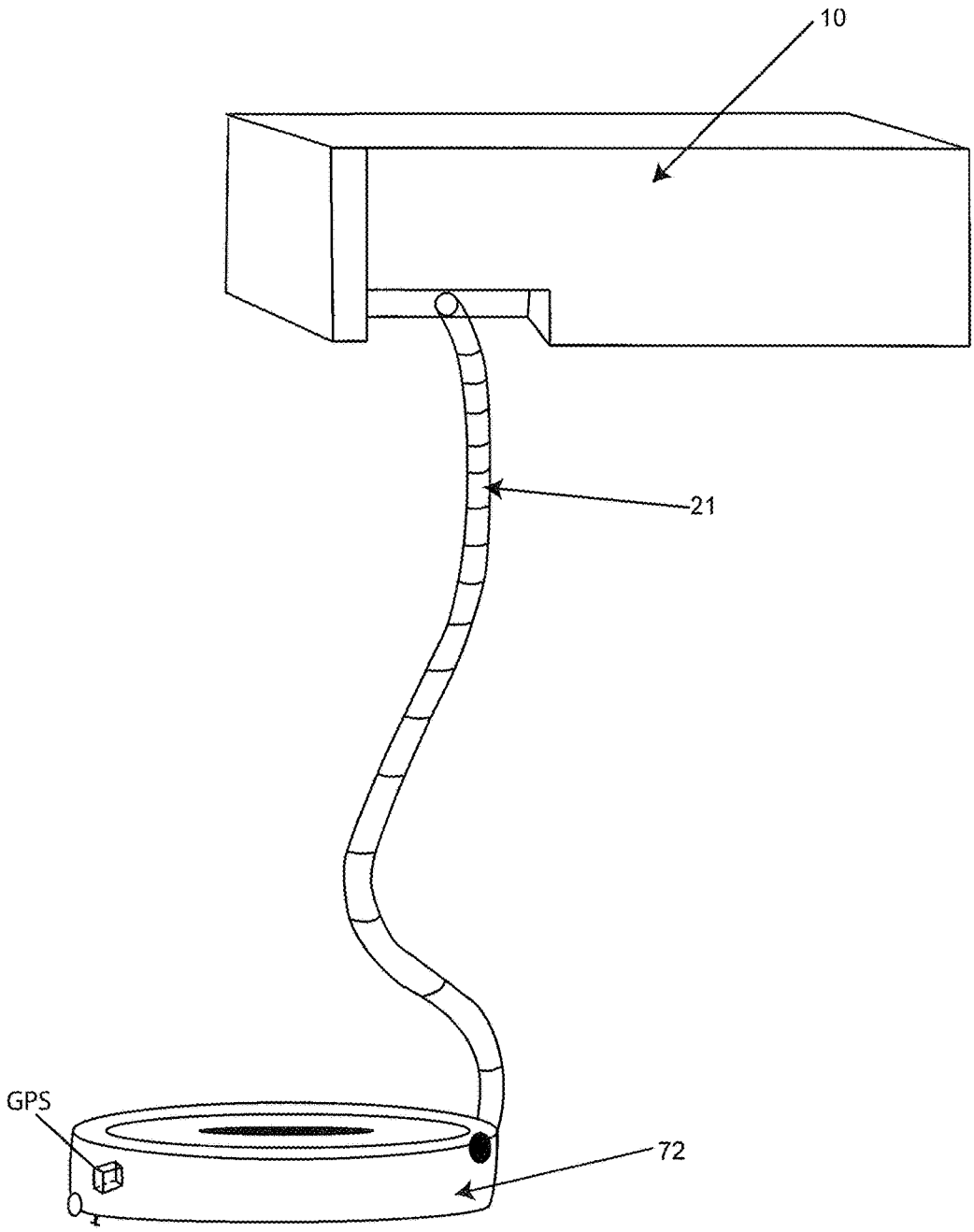
FIG. 8A is a perspective exterior view of another embodiment of the present invention.
Figure 8B:
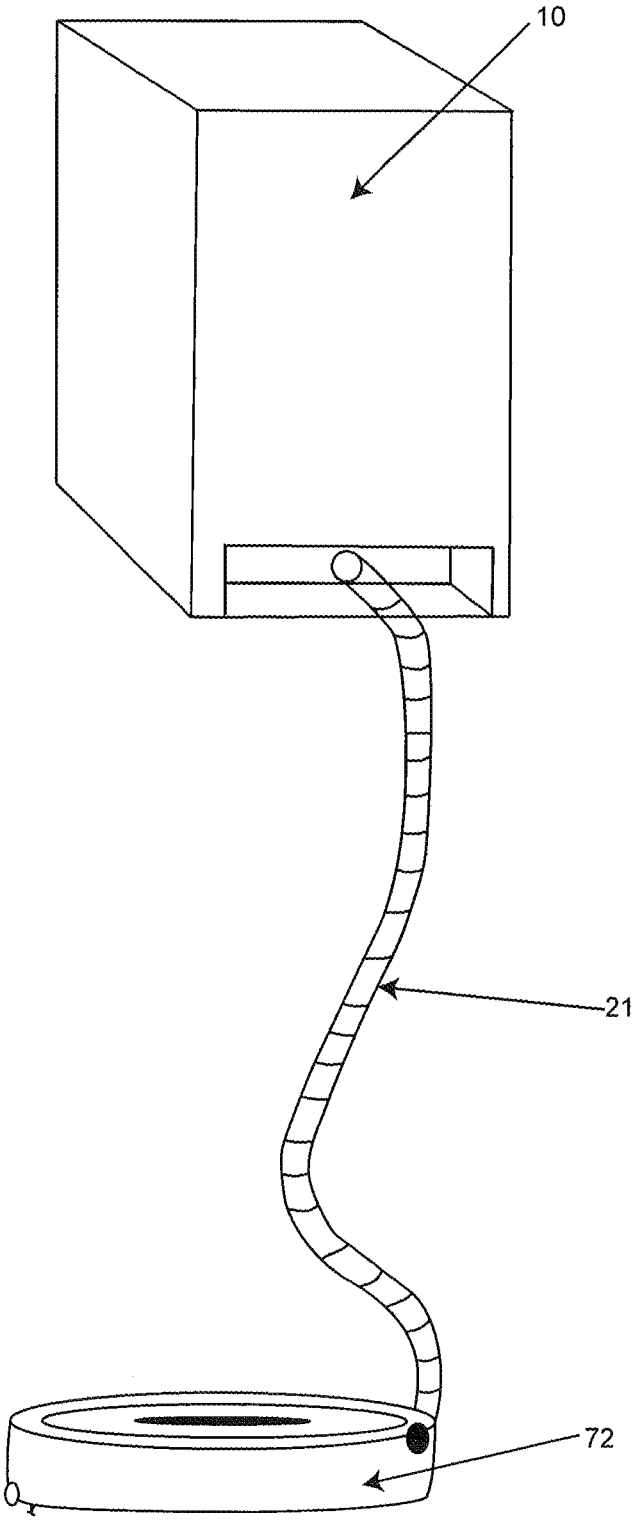
FIG. 8B is a perspective exterior view of another embodiment of the present invention.
Figure 8C:
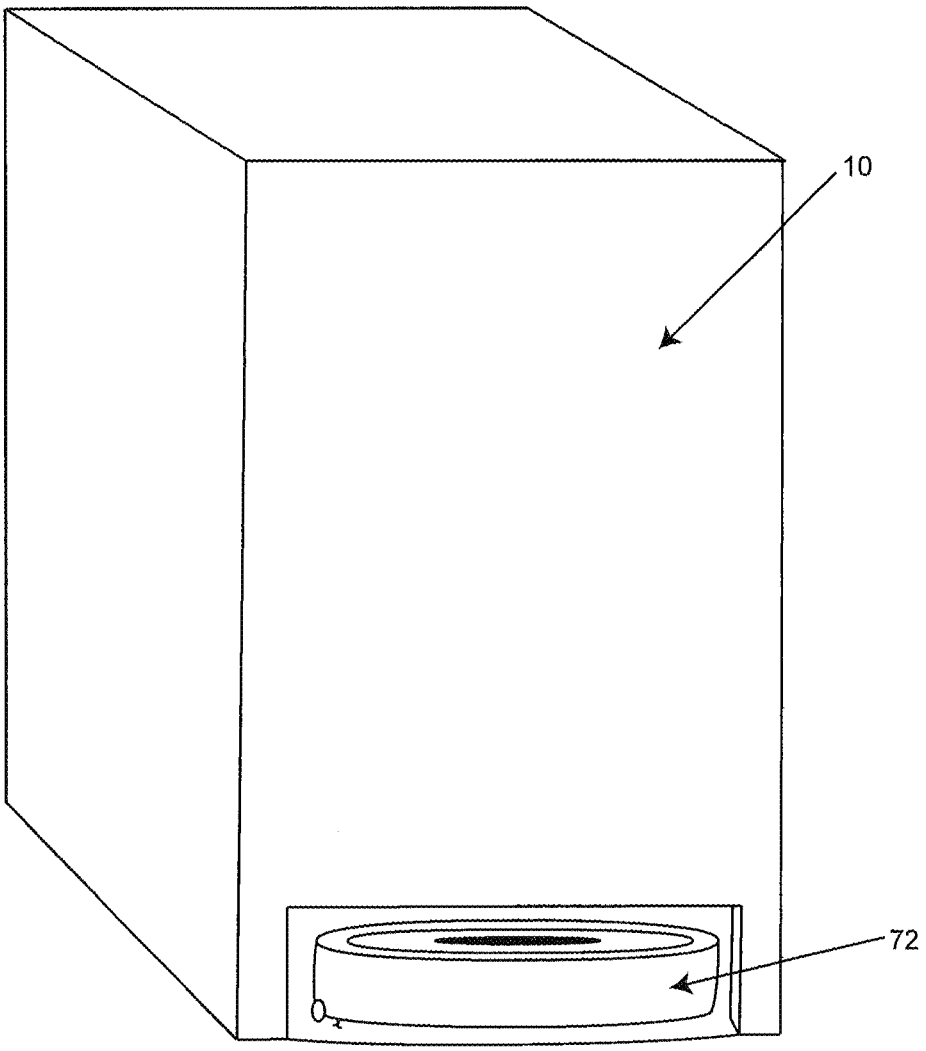
FIG. 8C is a perspective exterior view of another embodiment of the present invention.
Figure 9:
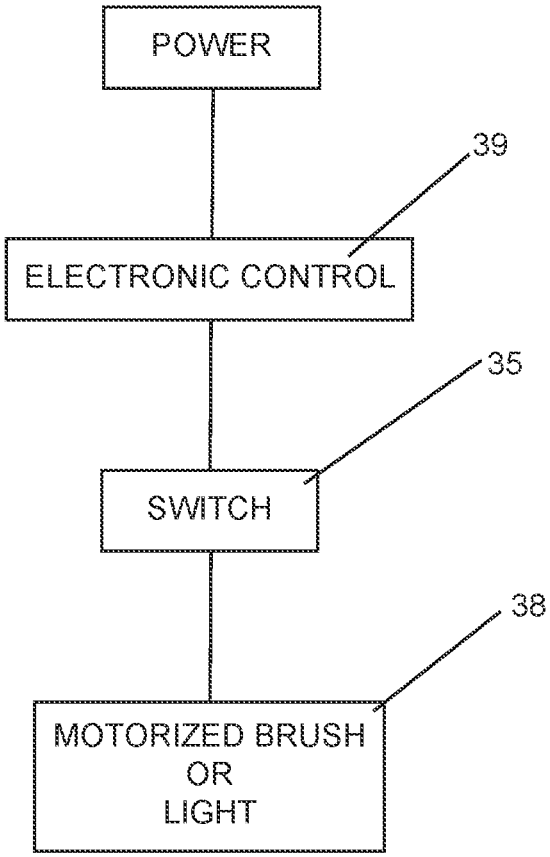
FIG. 9 is a schematic view of a brush or light control of an embodiment of the invention.

As shown in FIGS. 8A-8C, some embodiments having proximity sensors may be used in conjunction with a robotic cleaning unit 72 at the distal end 28 of the hose. A signal generator 75 is provided on the robotic unit 72 which transmits location information about the unit when in use. As the robotic unit traverses an area for cleaning, the hose is allowed to extend, or is retracted, with the retraction occurring automatically according to the position of the robotic unit 72 at the end of the hose. In particular, when the programming and circuitry detects that too much hose has been withdrawn in relation to the position of the robotic unit, the retraction motor is automatically activated in order to pull in some of the extra hose. In these embodiments, when the robotic unit is finished cleaning, it may send a signal that retracts the entire hose as well as the robotic unit back to the housing, as shown in FIG. 8C.

It is to be understood that other sealing and hose arresting devices are contemplated within the scope of the present invention.

It should also be understood that the foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A vacuum unit comprising:

a) a housing;

b) a first chamber in said housing having a first suction source therein for removing air from an adjacent debris collection chamber;

c) a second chamber in said housing separated from said first chamber and from said debris collection chamber, said second chamber having a second suction source therein for removing air from an adjacent third chamber in said housing, said third chamber being separated from said first chamber and from said debris collection chamber;

d) a port in said third chamber for communication between an interior and exterior of said third chamber;

e) an elongated vacuum hose provided in said third chamber wherein a first end of said hose extends through a sealed coupling into said debris collection chamber and is sealingly attached to a side or bottom of a debris collection bag, such that suction from said first suction source is transmitted through said bag to said hose, said hose being movably extendable through said port;

f) an opening between said third chamber and said second chamber such that suction from said second chamber is transmitted into said third chamber for retracting said hose into said third chamber;

g) a deflector attached inside said third chamber adjacent to said port for deflecting said hose into said third chamber during retraction; and h) at least one switch at an opposite end of said hose for electronically controlling said first and second suction sources.

2. The vacuum unit of claim 1 wherein said second suction source comprises at least one vacuum motor controlled independently of said first suction source.

3. The vacuum unit of claim 2 wherein said at least one vacuum motor is operable to create negative air pressure in said third chamber of at least 150 mm H2O.

4. The vacuum unit of claim 2 wherein said at least one vacuum motor is operable to create negative air pressure in said third chamber of between 1000 mm H20 and 4000 mm H2O.

5. The vacuum unit of claim 2 wherein said at least one vacuum motor is operable to create negative air pressure in said third chamber of at least 3000 mm H2O.

6. The vacuum unit of claim 2 wherein said hose comprises a length having a range of between 40 feet and 60 feet, and wherein said at least one vacuum motor is operable to create suction force at said port sufficient to draw said hose into said third chamber.

7. The vacuum unit of claim 1 further comprising a plurality of wheels and a retractable power cord.

8. The vacuum unit of claim 1 further comprising at least one electronic attachment at said opposite end of said hose selected from the group of a motorized brush, a light source, and combinations thereof.

9. The vacuum unit of claim 1 wherein said switch comprises at least one setting selected from the group of a vacuum setting, a retraction setting, an "off" setting, and combinations thereof.

10. The vacuum unit of claim 1 wherein said port comprises a collar, the collar being operable to adjust an inner dimension of the hose outlet port.

11. A method of using a hose retraction apparatus, the method comprising the steps of:

providing the hose retraction apparatus comprising: a hose chamber for storing a hose, said hose chamber comprising a hose outlet port and a deflector inside said hose chamber adjacent to said outlet port for deflecting said hose into said hose chamber during retraction; the hose traversing said hose outlet port, said hose having a proximal end and a distal end, said distal end comprising a switch operable to control a primary vacuum source and a secondary vacuum source; said primary vacuum source being provided in a separate first chamber adjacent to a debris collection chamber for removing air from said debris collection chamber; said primary vacuum source being in fluid communication with said proximal end of said hose for creating a partial vacuum in said hose; said proximal end being sealingly attached to a side or bottom of a debris collection bag in said debris collection chamber; said secondary vacuum source being provided in a separate second chamber adjacent to said hose chamber for removing air from said hose chamber; and said secondary vacuum source being in fluid communication with said hose chamber for creating a partial vacuum therein, wherein said hose may be drawn into said hose chamber by engaging said secondary vacuum source to create a suction force inside said hose chamber;

engaging said primary vacuum source via said switch to perform a vacuuming session; and engaging said secondary vacuum source via said switch to create said partial vacuum in said hose chamber and draw said hose into said hose chamber.

12. The method of claim 11 wherein said switch is in electronic communication with said primary vacuum source and said secondary vacuum source, and comprises a plurality of settings, said plurality of settings comprising one of the group of a vacuum setting, a retraction setting, an "off" setting, and combinations thereof.

* * * * *